US008667958B2

(12) United States Patent
Cadima

(10) Patent No.: US 8,667,958 B2
(45) Date of Patent: Mar. 11, 2014

(54) BURNER ILLUMINATION IN AN APPLIANCE

(75) Inventor: Paul Bryan Cadima, Louisville, KY (US)

(73) Assignee: General Electric Company, Schenectady, NY (US)

( * ) Notice: Subject to any disclaimer, the term of this patent is extended or adjusted under 35 U.S.C. 154(b) by 436 days.

(21) Appl. No.: 12/955,079

(22) Filed: Nov. 29, 2010

(65) Prior Publication Data

US 2012/0132191 A1 May 31, 2012

(51) Int. Cl.
*F24C 15/10* (2006.01)

(52) U.S. Cl.
USPC ..... 126/213; 126/39 R; 126/39 BA; 126/39 E

(58) Field of Classification Search
USPC ..... 126/39 R, 213, 37 A, 40, 42, 39 E, 39 H, 126/39 J, 39 N, 39 M, 39 K, 39 BA; 219/445.1, 446.1, 448.1, 456.1, 538, 219/452.12; 431/354, 13; 362/617
See application file for complete search history.

(56) References Cited

U.S. PATENT DOCUMENTS 2,659,069 A * 11/1953 Kinsella ..... 219/445.1
2,870,316 A * 1/1959 Ferguson, Jr. ..... 219/445.1
3,186,472 A * 6/1965 Caravella ..... 126/42
4,794,233 A * 12/1988 Goessler et al. ..... 219/445.1
4,990,750 A * 2/1991 Martel et al. ..... 219/445.1
5,162,636 A * 11/1992 Randolph et al. ..... 219/445.1
5,448,036 A 9/1995 Husslein et al.
6,053,795 A * 4/2000 Whitney et al. ..... 446/219
6,104,007 A 8/2000 Lerner
6,300,602 B1 * 10/2001 Platt et al. ..... 219/445.1
6,369,365 B1 * 4/2002 Nass et al. ..... 219/445.1
6,639,190 B2 10/2003 Lerner
6,700,100 B2 3/2004 Lerner
6,806,444 B2 * 10/2004 Lerner ..... 219/445.1
6,807,962 B2 * 10/2004 Taplan et al. ..... 126/39 B
6,966,315 B2 * 11/2005 Pickering ..... 126/39 E
7,041,945 B2 * 5/2006 Aihara et al. ..... 219/622
7,087,865 B2 8/2006 Lerner
7,112,766 B2 9/2006 Lerner
7,173,221 B2 2/2007 Lerner
2007/0204849 A1 * 9/2007 Johnson ..... 126/213
2012/0118281 A1 * 5/2012 Shigeoka et al. ..... 126/1 R
2012/0171343 A1 * 7/2012 Cadima et al. ..... 426/520

FOREIGN PATENT DOCUMENTS

GB 2202044 A * 9/1988

* cited by examiner

*Primary Examiner* — Kang Hu
*Assistant Examiner* — John C Hailey, III
(74) *Attorney, Agent, or Firm* — Global Patent Operation; Douglas D. Zhang

(57) ABSTRACT

An appliance includes a cooktop, a gas burner assembly disposed in the cooktop, the gas burner assembly having a burner head portion and a burner base portion, and a light disc disposed beneath the burner head portion.

19 Claims, 11 Drawing Sheets

BURNER ILLUMINATION IN AN APPLIANCE

BACKGROUND OF THE INVENTION

The present disclosure generally relates to appliances, and more particularly to illumination of a burner in an appliance.

In a stove or cooktop that includes a gas burner, it can sometimes be difficult to determine when the burner is active or on without checking the status of the burner control. In some instances, fiberoptic cables or light pipes have been used to carry light to a section of the top cap of a gas burner. Some of the problems associated with attempts to illuminate a section of the top cap of a gas burner can include potential gas leaks, assembly difficulties, cleaning, and interference with the gas flow through an interior of the burner. Also, when cookware is placed on top of the burner, the light can be obstructed by the cookware.

It would be advantageous to be able to illuminate a gas burner in a manner that ensures ease of assembly and cleaning, does not present any burner operation problems or potential for gas leaks, and eliminates the need for expensive light pipes. It would also be advantageous to illuminate a gas burner in a manner that the lighting is more visible when cookware is placed on top of the burner. Accordingly, it would be desirable to provide a system and apparatus that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to an appliance. In one embodiment, the appliance includes a cooktop, a gas burner assembly disposed in the cooktop, the gas burner assembly having a burner head portion and a burner base portion, and a light disc disposed beneath the burner head portion.

In another aspect, the disclosed embodiments are directed to a lighting system for a gas burner assembly of an appliance. In one embodiment the lighting system includes a light disc, a base portion of the gas burner assembly disposed above the light disc and a cooktop configured to support the light disc and gas burner assembly. The cooktop includes an opening in a surface of the cooktop, the opening exposing an underside of the light disc. A light source is disposed away from an underside of the cooktop and configured to direct light into the opening and the underside of the light disc.

In a further aspect, the disclosed embodiments are directed to a lighting system for a gas burner assembly of an appliance. In one embodiment, the lighting system includes a light disc, a burner portion of a side of the burner portion including an opening, the opening configured to receive the light disc, a cooktop configured to support the gas burner assembly, the cooktop including an opening in a surface of the cooktop. An underside of the burner portion includes an opening corresponding in location to the opening in the surface of the cooktop, the opening in the underside of the gas burner portion exposing an underside of the light disc. A light source is disposed away from an underside of the cooktop, the light source being configured to direct light into the opening and the underside of the light disc.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
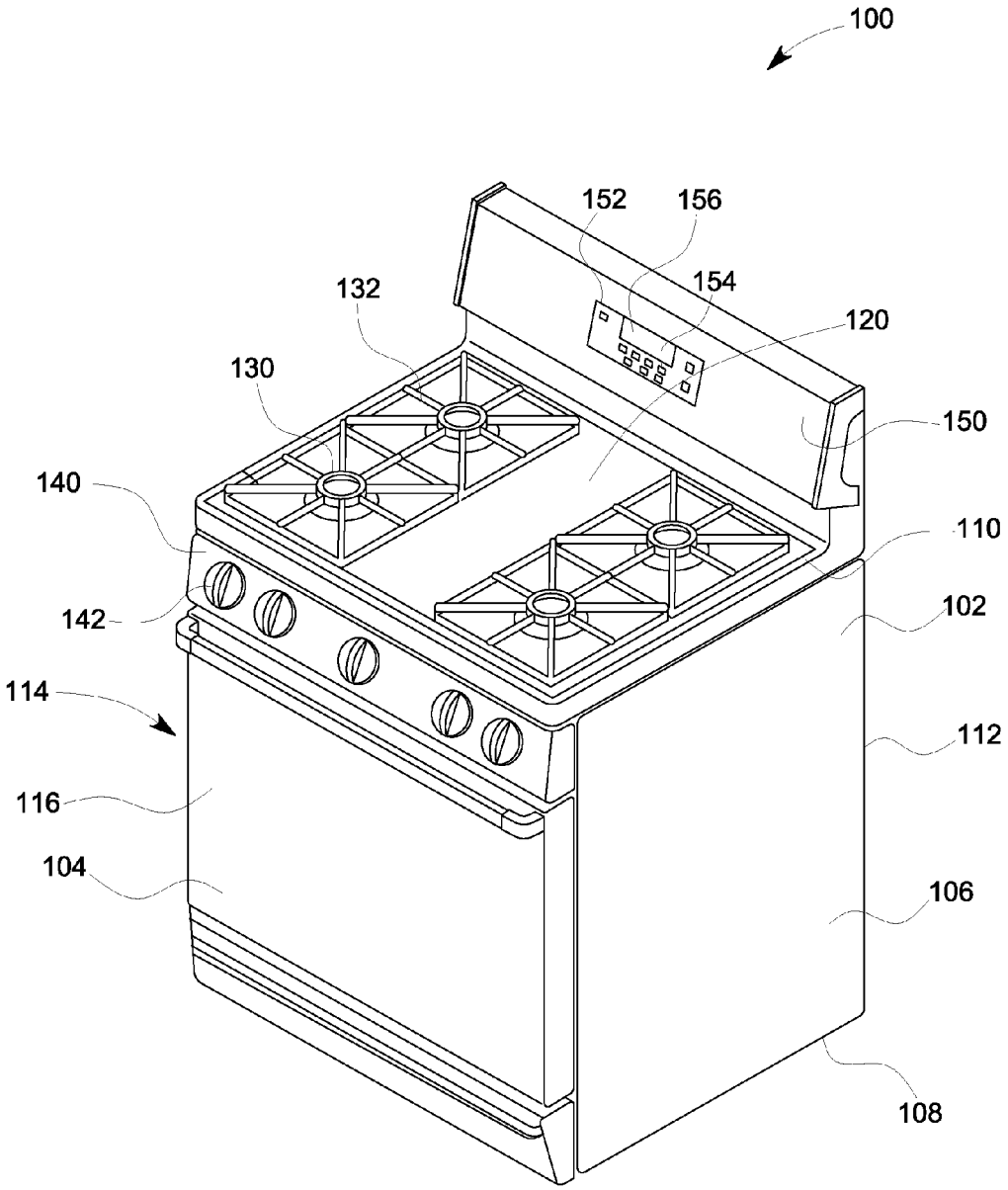
FIG. 1 is a perspective view of an exemplary range incorporating aspects of the disclosed embodiments.

Referring to FIG. 1, an exemplary appliance such as a freestanding range in accordance with the aspects of the disclosed embodiments is generally designated by reference numeral 100. The aspects of the disclosed embodiments are generally directed to illuminating a gas burner on a cooktop. Although a range 100 is shown in FIG. 1, the aspects of the disclosed embodiments can be applied to any appliance that includes a gas burner, such as a cooktop.

As is shown in FIG. 1, the range 100 includes a cabinet or housing 102 that has a front portion 104, opposing side panels 106, a base or bottom portion 108, a top portion 110, and a back panel 112. In the embodiment shown in FIG. 1, the top portion 110 of the range 100 includes a maintop or cooktop 120. In one embodiment, the range 100 can also include an oven unit 114. In the example shown in FIG. 1, the oven unit 114 includes a front-opening access door 116.

In the exemplary range 100 of FIG. 1, the cooktop 120 includes four gas fueled burner assemblies 130 that are positioned in a spaced apart relationship. In alternate embodiments, the cooktop 120 can include any number of gas fueled burner assemblies 130 arranged in any suitable configuration. Each burner assembly 130 generally extends upwardly through an opening in the cooktop 120. In one embodiment, a grate 132 can be positioned over each burner assembly 130. Each grate 132 can include horizontally extending support structures thereon for supporting cooking vessels. Although the gas burner assemblies 130 are shown in FIG. 1 as being substantially similar, in alternate embodiments, the gas burner assemblies 130 can be of different sizes to accommodate different sized cooking vessels.

In one embodiment, the cabinet 102 of the range 100 includes a control surface 140 that supports one or more controls, generally referred to herein as burner controls 142. The burner control or control knob 142 shown in FIG. 1 is generally in the form of a knob style control that extends outwardly from and can be supported by the control surface 140. Although the example of FIG. 1 shows the burner control knob 142 on the front 104 of the cabinet 102, in alternate embodiments, the burner control knob 142 can be located in any suitable location on the cabinet 102, such as for example the backsplash 150.

As shown in FIG. 1, the back splash 150 includes a control panel 152. In one embodiment, the back splash 150 includes a plurality of input selectors or switches 154 and a display 156. In one embodiment, the control panel 152 is in cooperation with burner control knob 142 to form a user interface for selecting and displaying cooking cycles, warming cycles and/or other operating features, including enabling an illumination of the gas burner assembly 130. In one embodiment, the input selectors or switches 154 can be in the form of push buttons or electronic switches.

In one embodiment, the oven 100 includes a controller 158 (not shown). The controller 158 is coupled to, or integrated within, the control panel 152 and configured to receive inputs and commands from for example, the controls 142 and 154, and control the various operations and functions of the oven 100. In one embodiment, the controller 158 can include or comprise an electronic range control, and can be used to control the illumination of the gas burner assemblies 130, as is further described herein.

Figure 2:
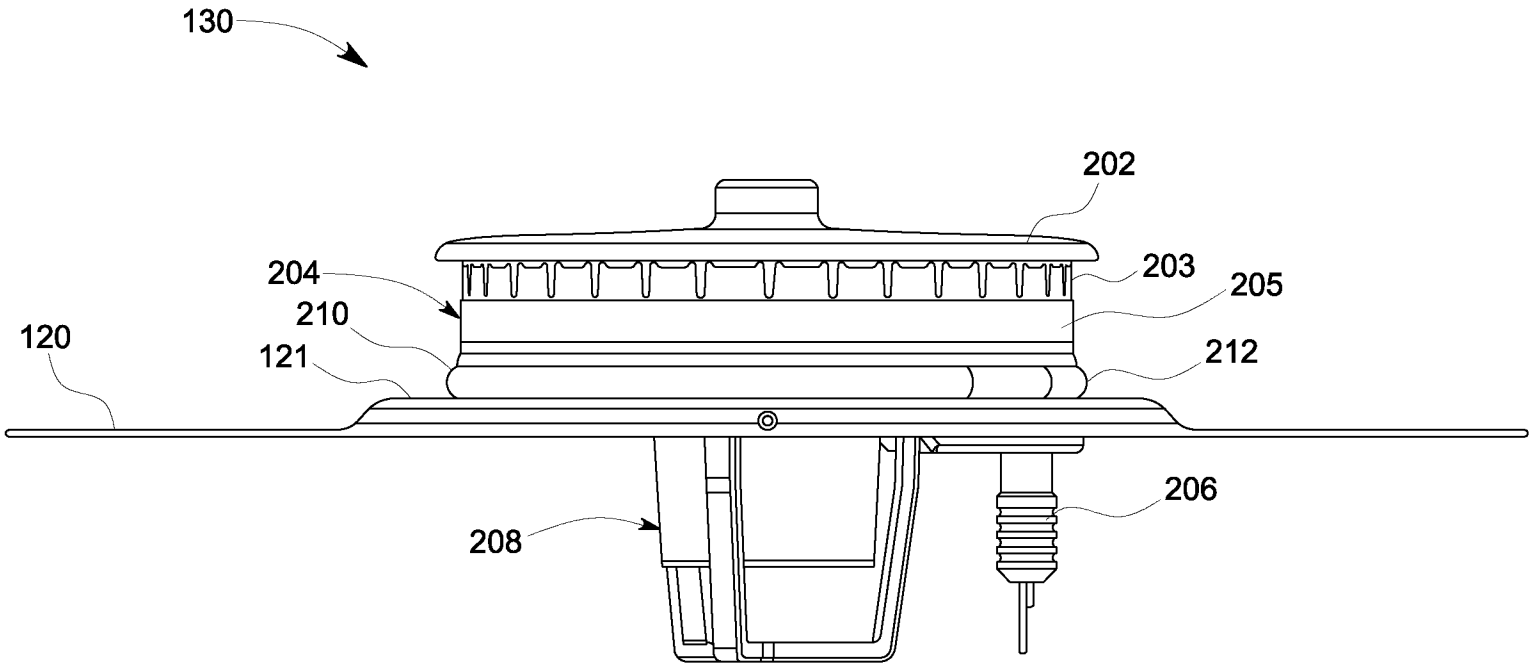
FIG. 2 is side view of an exemplary gas burner assembly and cooktop incorporating aspects of the disclosed embodiments.

FIG. 2 is a side view of one embodiment of a gas burner assembly 130 incorporating aspects of the disclosed embodiments. As is shown in the example of FIG. 2, the gas burner assembly 130 includes a burner cap 202, a burner 204, an electrode or igniter assembly 206 and a venturi assembly 208. The gas burner assembly 130 can include such other suitable components as will generally be understood. In one embodiment, the gas burner 204 comprises a burner head portion 203 and a burner base portion 205. The burner head portion 203 and the burner base portion 205 can be integrated into or form a single or unitary burner structure. In alternate embodiments, the burner head portion 203 and the burner base portion 205 of the gas burner 204 are separate components or assemblies. In the embodiment shown in FIG. 2, a light disc 210 is positioned beneath the burner 204. In this example, the light disc 210 is between the burner base portion 205 of the burner 204 and a surface 121 of the cooktop 120. In one embodiment, referring to FIG. 4, a gasket 402 can be positioned between the light disc 210 and the surface 121. The surface 121 can also be referred to as the maintop or cooktop volcano or emboss. The light disc 210 is generally configured to be illuminated and distribute light from one or more of its surfaces. In one embodiment, light that is directed into a bottom side of the light disc 210 is transmitted out a perimeter edge or side 212 of the light disc 210. In alternate embodiments, the light disc 210 can be configured to allow light to be emitted from any suitable area of the light disc 210, such as a top or bottom surface or portion thereof. In an embodiment where the area occupied by the light disc 210 is larger than the area covered by the burner 204, light could be emitted from areas or regions that are exposed or not otherwise covered by the burner 204. In this example, light could be emitted from the side 212, the top or any combination thereof of the light disc 210.

In one embodiment, the light disc 210 is a glass disc, such as a high temperature ceramic glass. The light disc 210 can be transparent, tinted, opaque or coated. For example, in one embodiment, the light disc 210 is tinted or coated with an opaque ink except in those areas into or from which it is desired to have light illuminate. The light entering the light disc 210 diffuses within the light disc 210 and in this example is guided to the perimeter side 212 of the light disc 210. In the example shown in FIG. 2, the burner 204 sits above or on top of the light disc 210.

Figure 3:
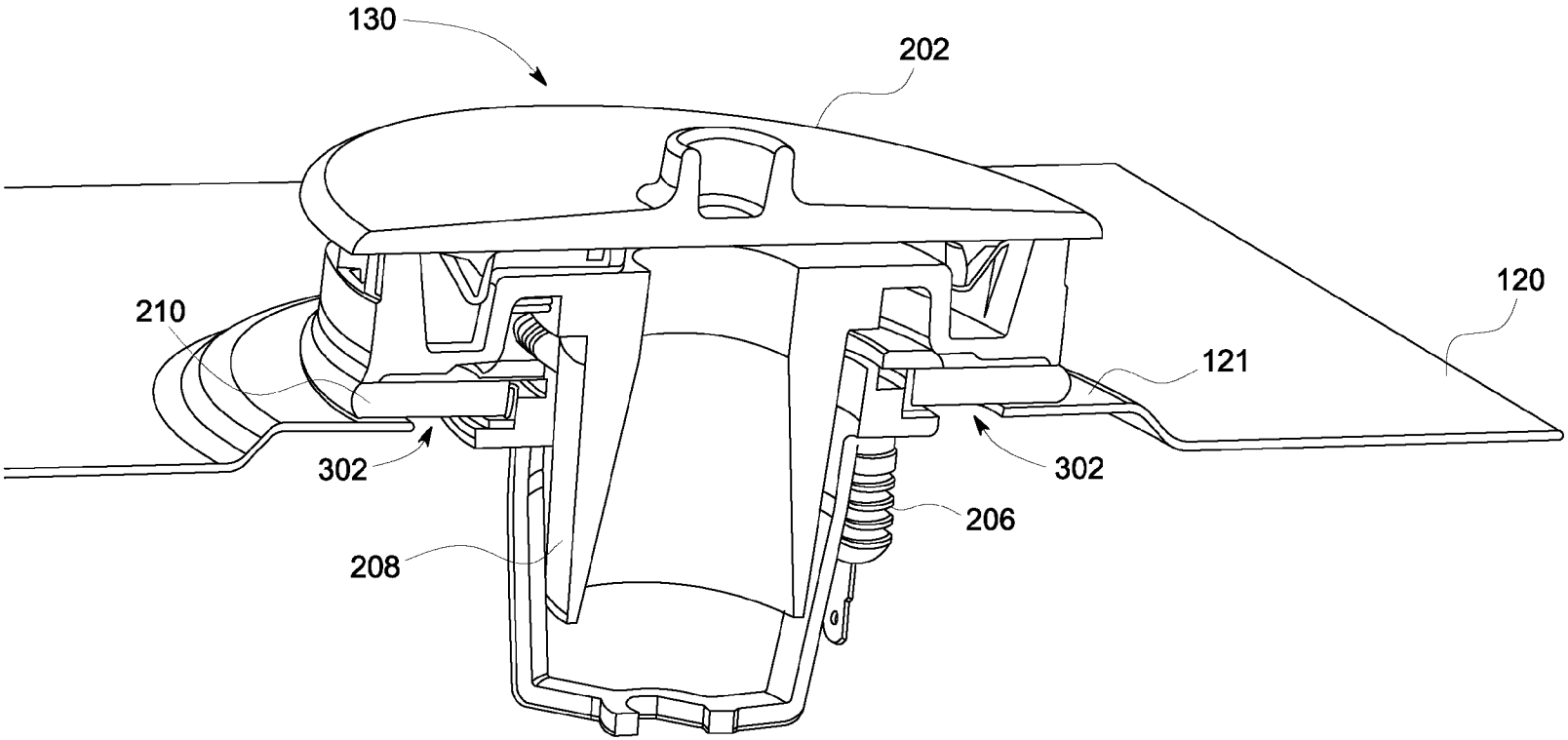
FIG. 3 is a cross-sectional view of the exemplary gas burner assembly and cooktop shown in FIG. 2.
Figure 4:
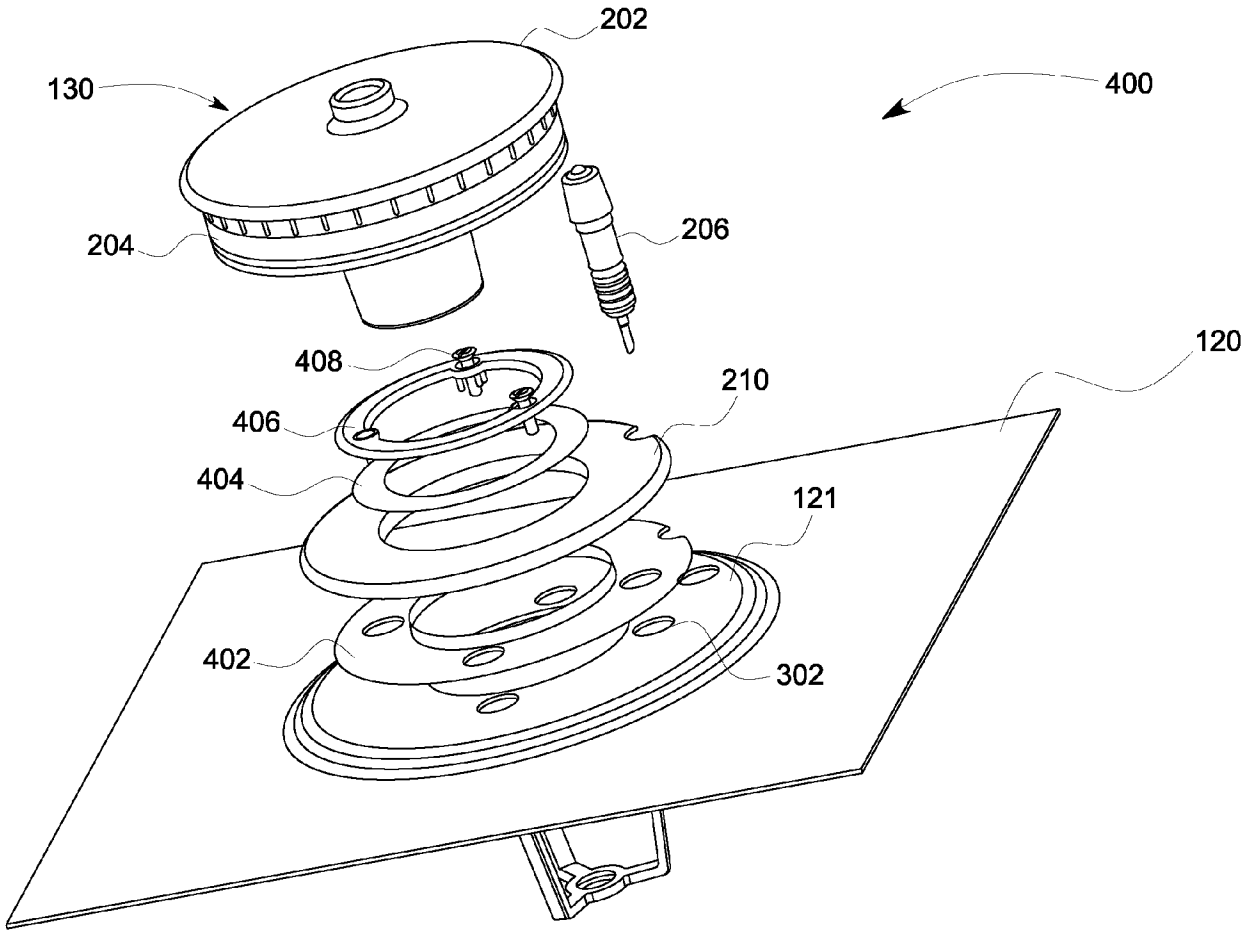
FIG. 4 is an assembly view of the exemplary gas burner assembly and cooktop shown in FIG. 2.
Figure 5:
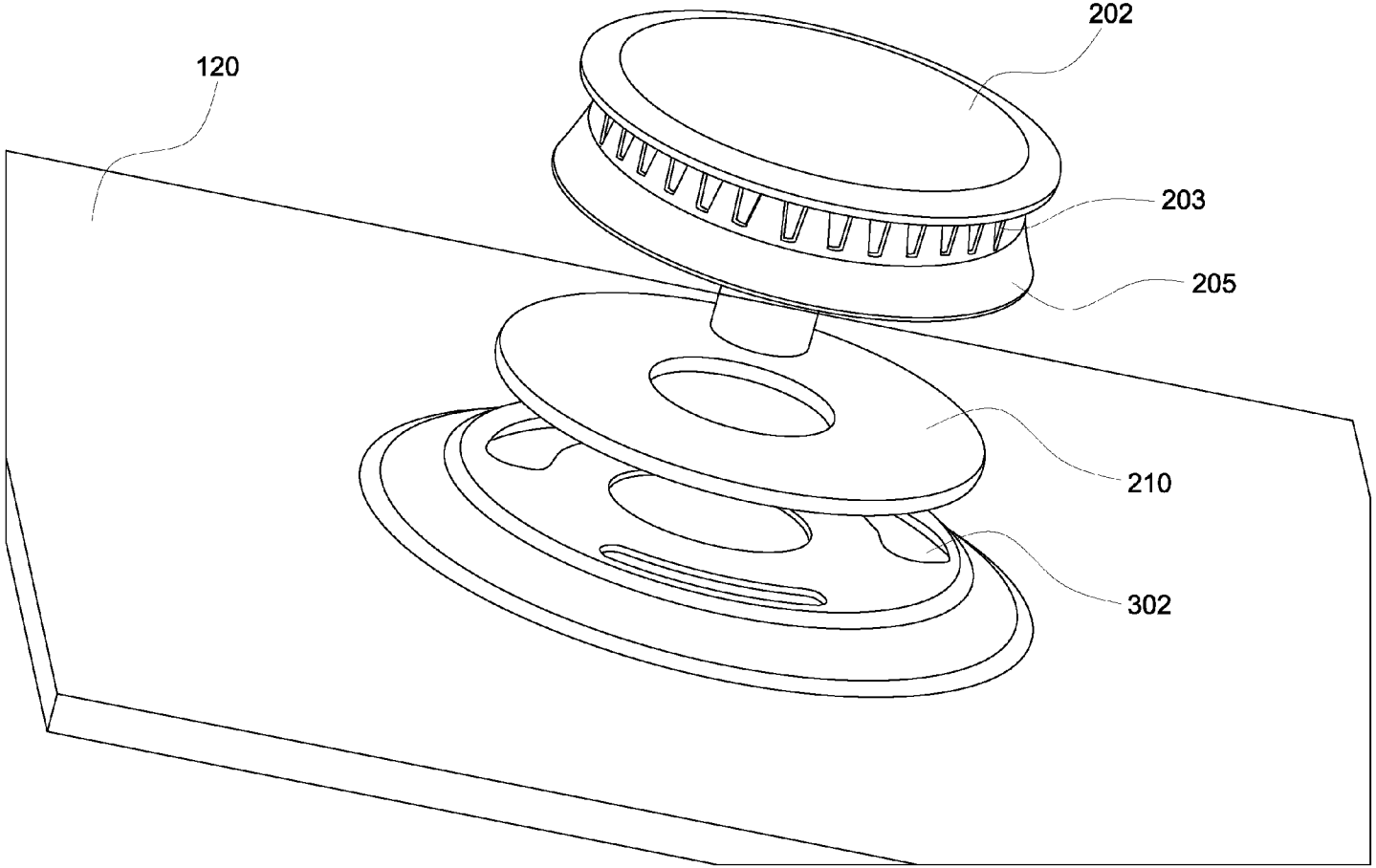
FIG. 5 is an assembly view of another embodiment of a gas burner assembly and cooktop incorporating aspects of the present disclosure.

Referring to FIGS. 3-5, in one embodiment, the cooktop 120 includes one or more opening or channels 302. The openings 302 are generally configured to provide a passageway for light to be received from underneath the cooktop 120 into the light disc 210. Although the openings 302 in FIGS. 3 and 4 are shown as substantially circular, in alternate embodiments, the openings 302 can comprise any suitable geometric shape of any suitable dimension. In one embodiment, referring to FIG. 5, the opening 302 is an elongated slot.

Referring to FIG. 4, one embodiment of an assembly 400 of the gas burner assembly 130, cooktop 120 and light disc 210 is shown. In this example, a lower gasket 402 is disposed between the surface 121 of the cooktop 120 and the light disc 210. The lower gasket 402 is generally configured to seal and protect the light disc 210 from surface irregularities of the cooktop surface 121. An optional upper gasket 404 is positioned between the light disc 210 and the burner 204 to provide a suitable seal and protect from surface irregularities. An adapter or retaining ring 406 is used to capture the top side of the light disc 210. In one embodiment the retaining ring 406 includes screws or fasteners 408. In alternate embodiments, the assembly 400 can include any suitable components and materials for securing the light disc 210 between the gas burner assembly 130 and the cooktop 120.

Figure 6:
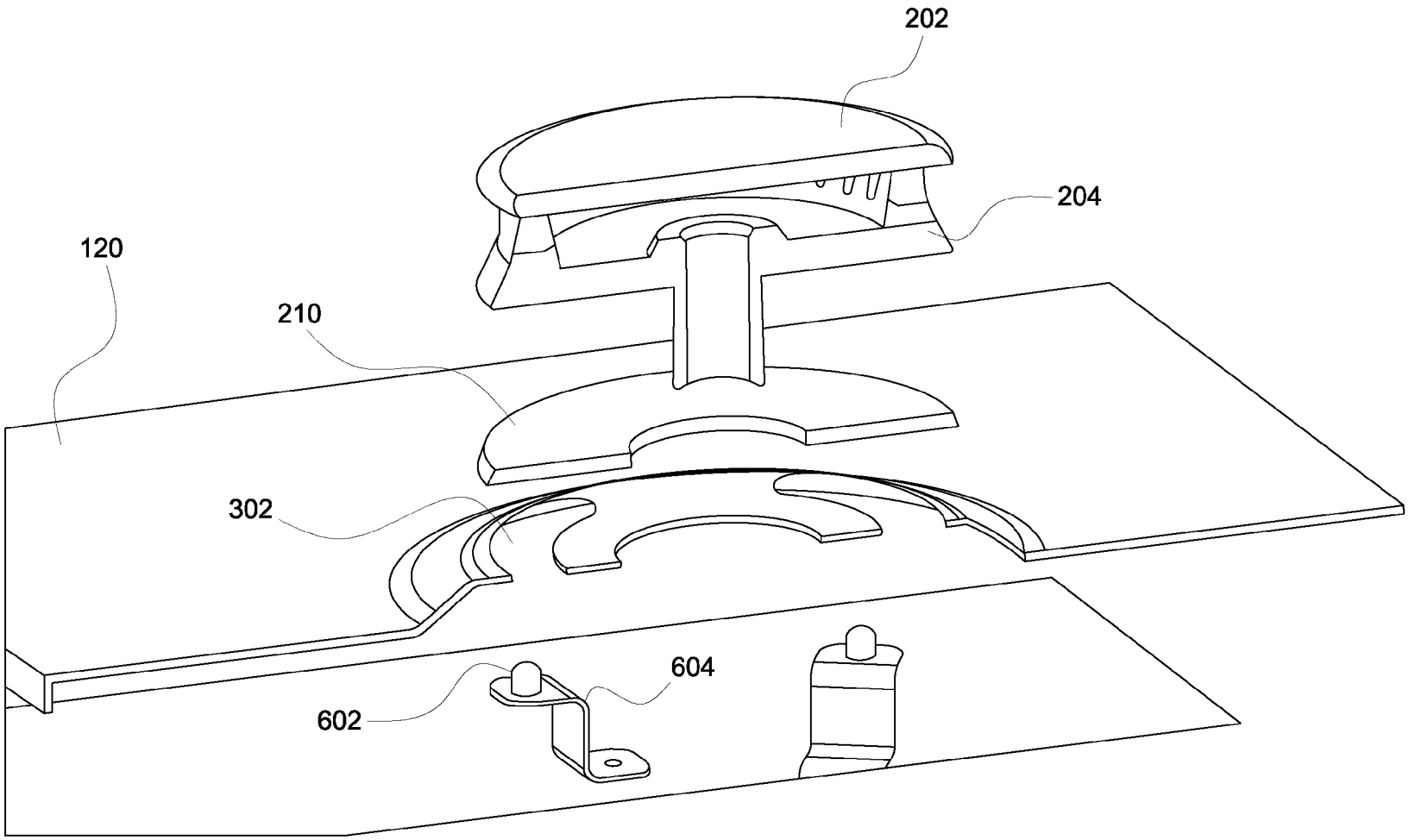
FIG. 6 is a cross-sectional assembly view of the gas burner assembly and cooktop shown in FIG. 5.
Figure 7:
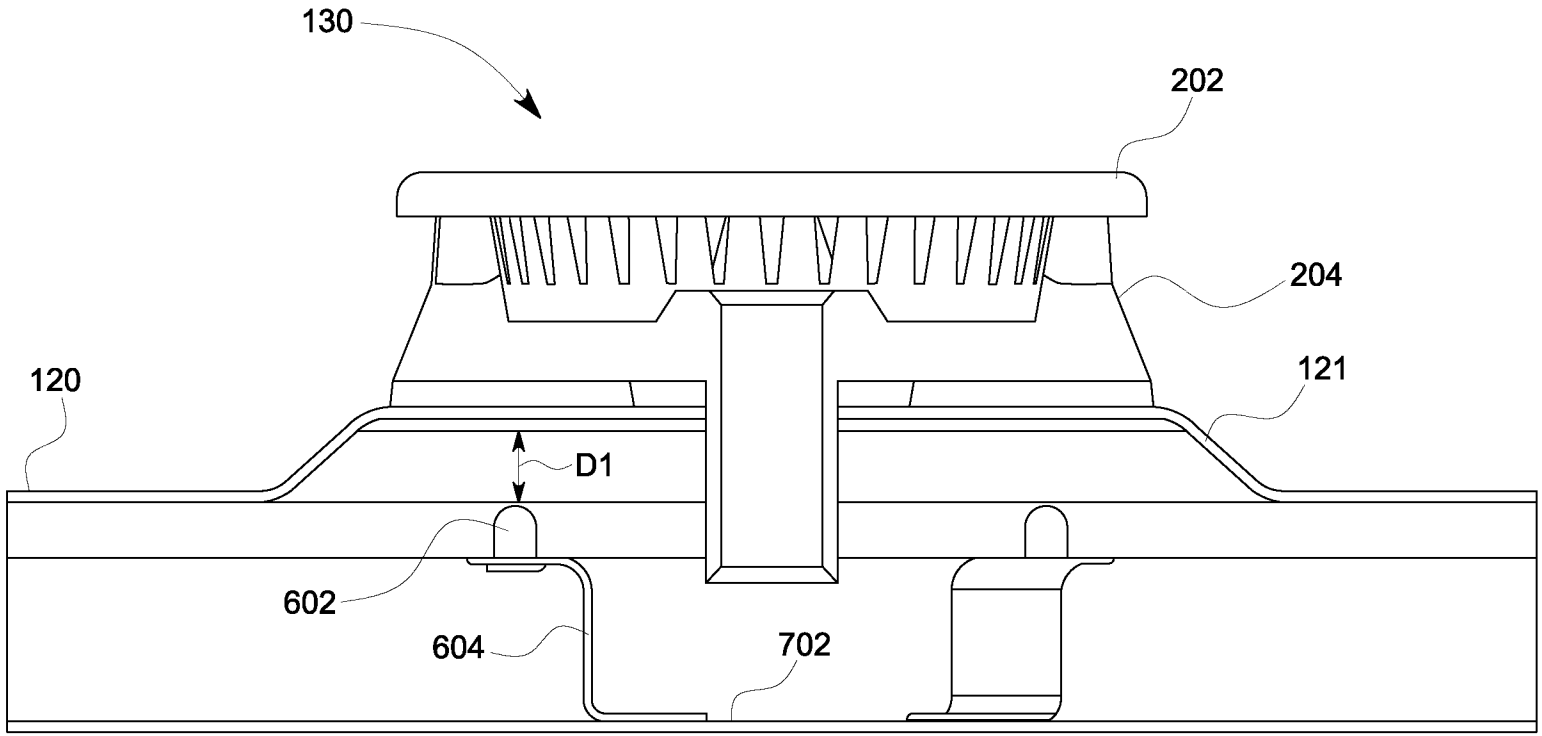
FIG. 7 is a cross-sectional view of the gas burner assembly and cooktop shown in FIG. 5 in an assembled state.

As shown in FIGS. 6 and 7, a light source 602 is configured to be mounted below the cooktop 120 and to transmit or shine light through the opening 302 against an underside of the light disc 210. The light source 602 is mounted to a suitable stand or support 604 arranged in general correspondence with the location or area of the opening(s) 302. Any number of light sources 602 can be used depending upon the degree and intensity of the illumination desired from the light disc 210. In one embodiment, the light source 602 is a light emitting diode or LED. The LED can be any suitable color. In one embodiment, a color changing LED or LED array can be used. As is shown in FIG. 7, in the assembled state, the LED 602 is positioned away from the heat output of the burner assembly 130 by a sufficient distance D1 below the cooktop volcano 121. This distance D1 allows the LED 602 to operate normally without being adversely affected by the heat output of the burner assembly 130. In one embodiment, the distance D1 is in the range of approximately 0.25 inches to approximately 3.5 inches. Generally, the LED 602 will be positioned as close to the LED mounting surface 702 in a bottom portion or surface of the cooktop 120 as possible, while still providing an adequate input of light intensity into the light disc 210.

The LED 602 is generally controlled by a switch in communication with the burner control 142 and/or the controller 158. In one embodiment, the LED 602 is generally configured to be powered-on or energized when the gas burner assembly 130 is energized, such as by turning the control knob 142. The illumination of the LED 602 can also be varied by the position of the control knob 142. For example, when the control knob 142 is in a low output position, the intensity of the LED 602, and the corresponding illumination of the light disc 210, can be at a minimum setting. When the control knob 142 is adjusted to a high output position, the intensity of the LED 602, and correspondingly the light disc 210, can be at a maximum level. Between the low and high setting positions of the control knob 142, the intensity level of the LED 602 and light disc 210 can be varied accordingly.

In one embodiment, the LED 602 can be figured to change color for different positional settings of the control knob 142. In this embodiment, the LED 602 is a color changing LED or LED array. At a low position setting of the knob 142, the LED 602 is one color. At a next or higher position setting of the knob 142, the LED 602 is another color. The number of color changes is dependent upon the number of colors associated with the LED 602. In one embodiment, the LED 602 can also be used to indicate that a temperature of the cooktop 120 and/or burner assembly 130 is hot, or at a temperature where user contact should be avoided. In this embodiment, a temperature sensor or switch (not shown) can be in communication with the LED 602 and/or controller 158 to control the on and off state, color, and intensity of the LED 602.

Figure 8:
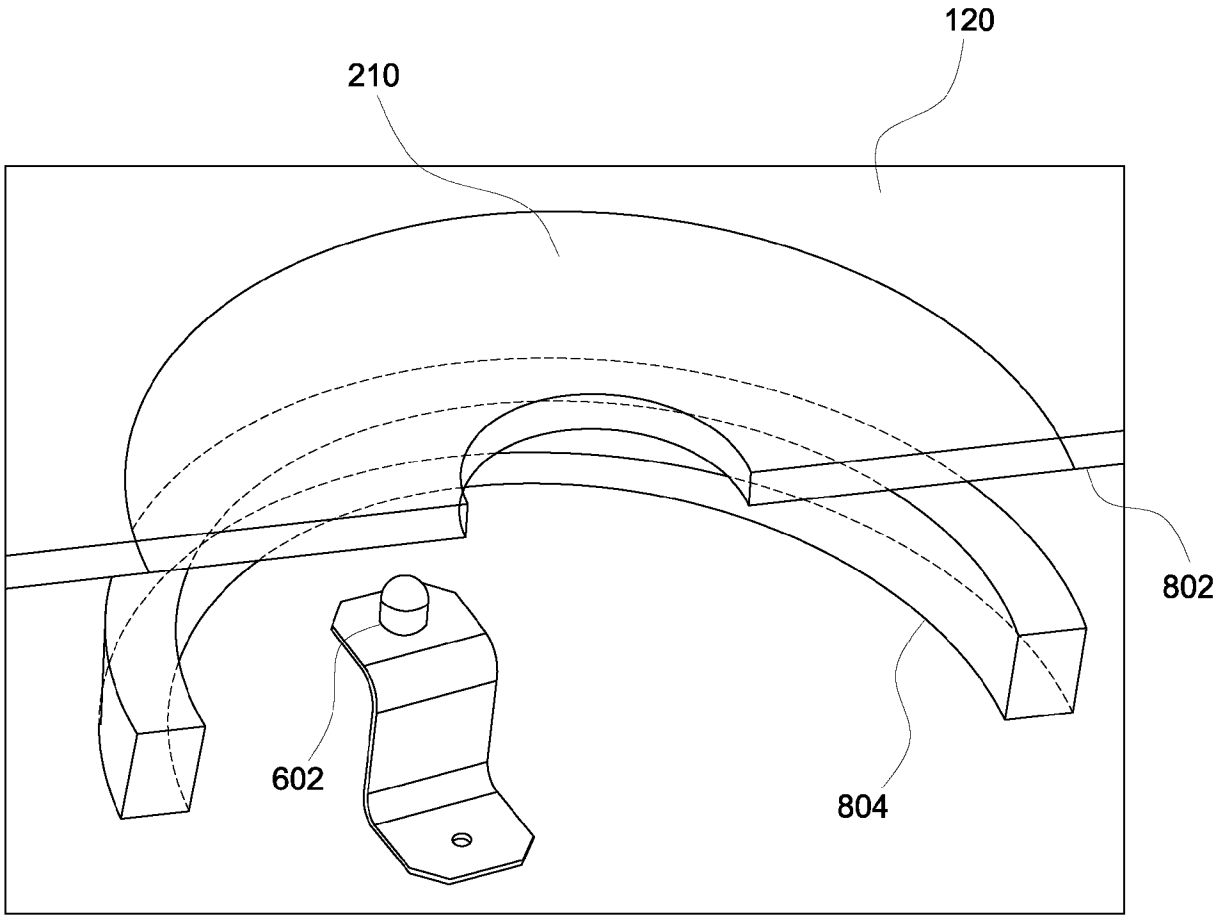
FIG. 8 is partial view of one embodiment of a glass cooktop incorporating aspects of the present disclosure.
Figure 10:
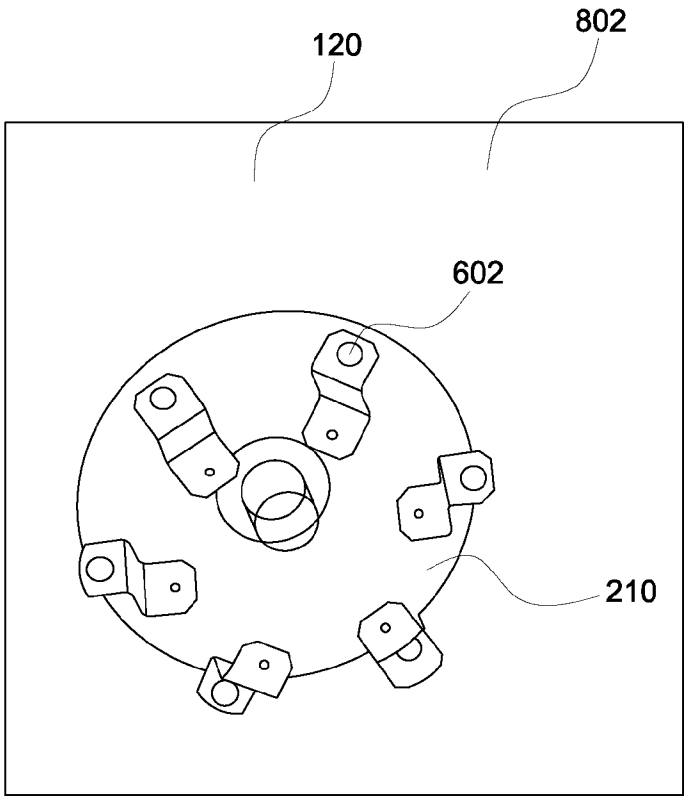
FIG. 10 is a bottom view of the gas burner assembly and glass cooktop assembly shown in FIG. 9.
Figure 9:
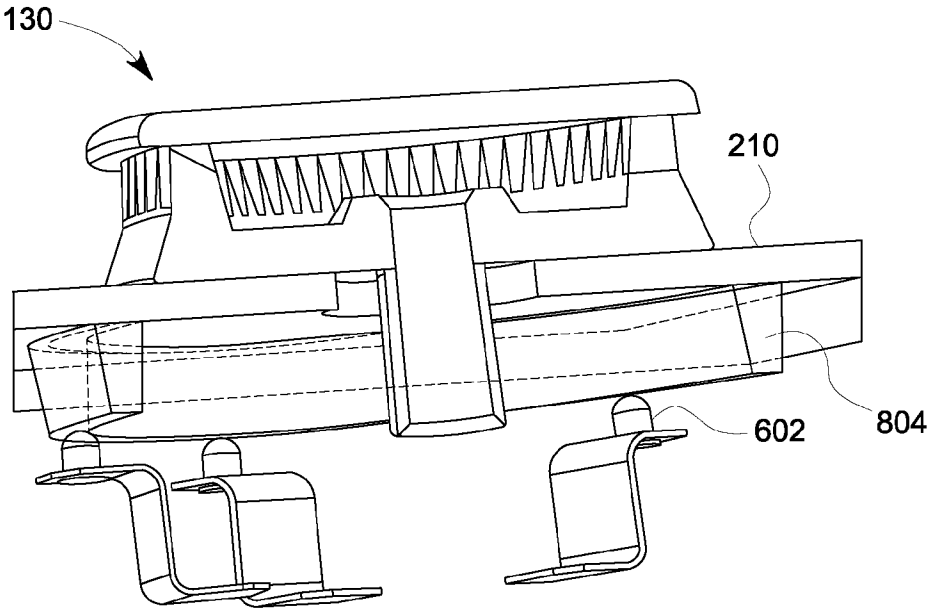
FIG. 9 is a cross-sectional view of one embodiment of a gas burner assembly and glass cooktop incorporating aspects of the present disclosure.

In one embodiment, referring to FIG. 8, where the cooktop 120 is glass, the light disc 210 can be integrated directly into the cooktop 120 to form a uniform structure. The glass of the cooktop 120 can be coated with an opaque coating 802 while the area around the burner 204 comprising the light disc 210 can be coated with a transparent ink or can remain clear. Alternatively, the coating 802 of the ceramic glass can be an ink screening. The coating 802 is generally applied to all of the areas of the cooktop 120 except those areas from which illumination is desired, such as the light disc 210. In one embodiment, the area encompassed by the light disc 210 exceeds the outer edge or circumference of the burner 204. All or a portion of this area can provide illumination or light. In one embodiment, a light diffusion ring 804 can be positioned between the light source 602 and the light disc 210, as is shown more clearly in FIG. 9. FIG. 10 illustrates a bottom up view of the cooktop 120, showing the coating 802 and light disc 210.

Figure 11:
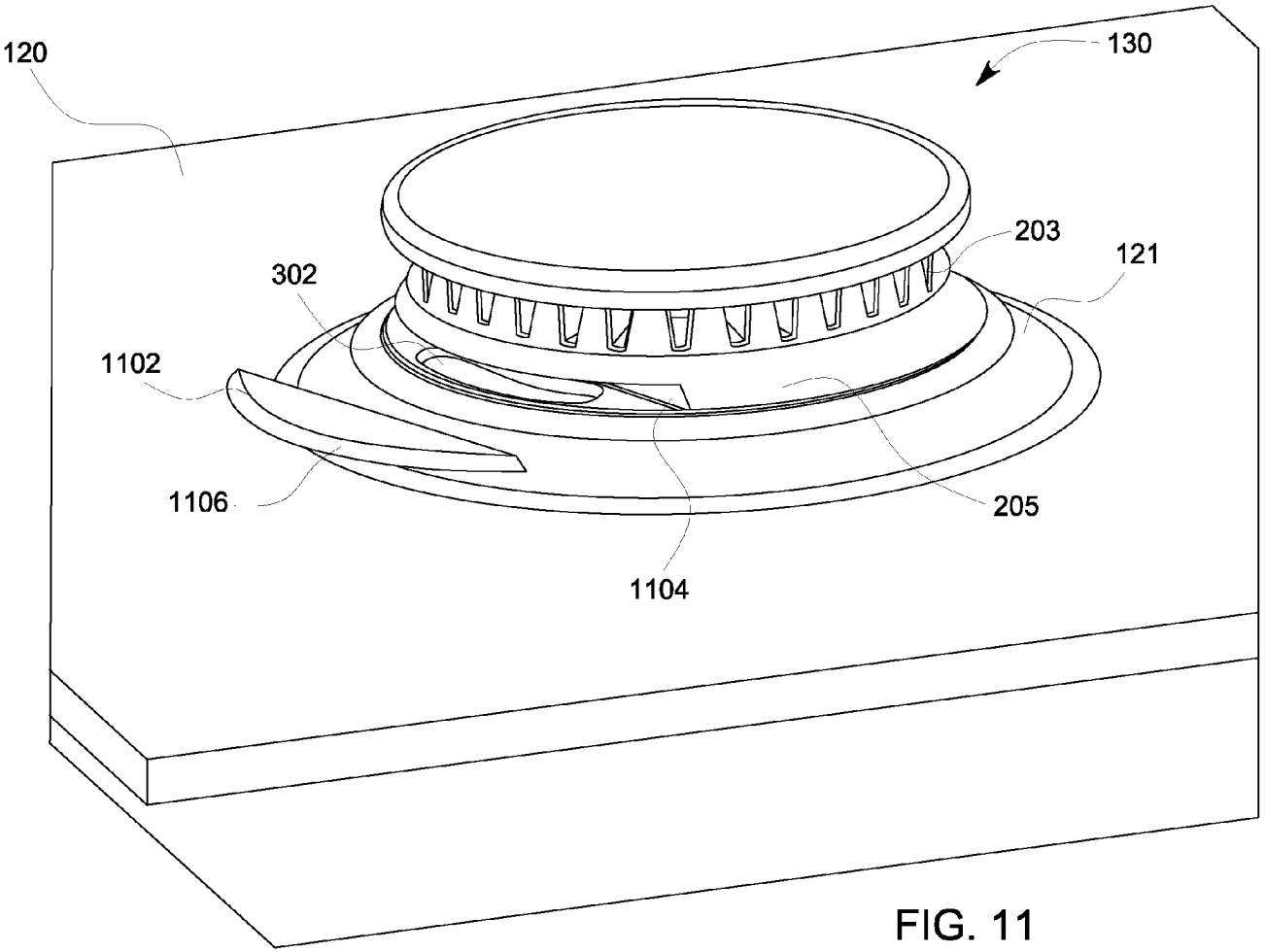
FIG. 11 is a perspective view of a gas burner assembly and cooktop incorporating aspects of the present disclosure.

FIG. 11 illustrates an embodiment where the burner base portion 205 of burner 204 includes an opening or slot 1104 into which a light disc 1102 can be inserted. In this example, the light disc 1102 is semi-circular, having an outer edge that generally corresponds in shape to a shape of the burner 204. In alternate embodiments, light disc 1102 and opening 1104 can be any suitable shape. The light disc 1102 is generally configured to be positioned within the opening 1104 so that an outer edge of the light disc 1102 is substantially flush with an outer surface of the burner base portion 205. The light transmitted into the opening 302 reflects in a diffuse manner by the surfaces of the light disc 1102, and exits the perimeter portion 1106 of the disc 1102. In one embodiment, one or more surfaces of the light disc 210 can be coated, as is generally described herein, or the surfaces of the burner 204 within the opening 1104, that correspond to the surfaces of the light disc 1102 can be coated with a reflective material. The length of the opening 1104 can be any suitable length and the depth of the opening 1104 is sufficient to allow the inserted disc 1102 to be positioned at least partially over the opening 302. In one embodiment, the disc 1102 is removable, and can be interchanged with other discs to provide different levels of light intensity and illumination or color.

Figure 12:
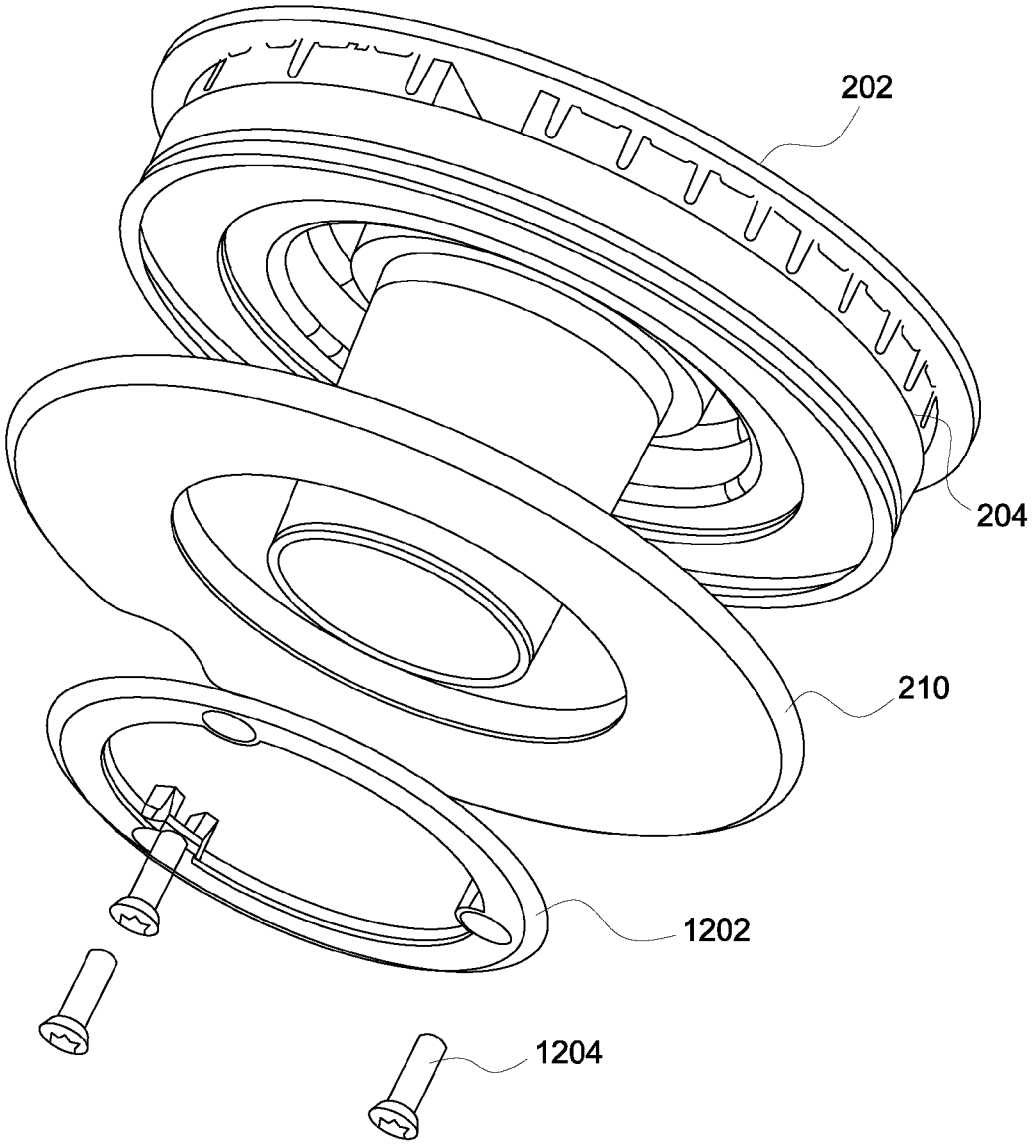
FIG. 12 is a perspective assembly view showing an exemplary attachment of a light disc to a gas burner assembly in accordance with aspects of the disclosed embodiments.

FIG. 12 illustrates an embodiment where the light disc 210 is attached to the burner 204 rather than the cooktop 120, as is shown in FIG. 4. In this example, a retaining ring 1202 captures the light disc 210 against the burner 204. Screws or fasteners 1204 can be used to secure the retaining ring 1202 to the burner 204. For purposes of the description herein, certain items such as gaskets between the various components of the assembly shown in FIG. 12 are not illustrated.

The aspects of the disclosed embodiments make use of a light transmitting disc for illumination of a burner in a range. The light disc may be disposed between the top surface of a cooktop and the burner base, integrated into an opening in the burner base, or is integrated into a glass cooktop. A light source, such as a light emitting diode assembly, is located underneath a top surface of the cooktop away from the heat of the gas burner. The cooktop includes an opening that channels the light from the light source into the light disc. The light disc can be coated in order to reflect the light within the disc in a diffuse manner from the coated areas of the glass and facilitate the exiting of the light from a particular portion of the light disc. The light transmitted through the disc can be used to indicate a status of the burner. The transmitted light can be turned on and off to indicate an on/off state or energization of the burner, varied in intensity to indicate a power level or intensity of the burner, or vary in color to indicate a status of the burner.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

a cooktop;

a gas burner assembly disposed in the cooktop, the gas burner assembly comprising a burner, the burner comprising a burner head portion and a burner base portion;

a light disc disposed beneath the burner head portion and above a surface of the cooktop; and an opening in a sidewall of the burner, the light disc being disposed in the opening.

2. The appliance of claim 1, wherein the light disc is disposed on a top surface of the cooktop.

3. The appliance of claim 1, wherein the light disc is integrated into a surface of the cooktop.

4. The appliance of claim 1, further comprising an opening in a bottom of the burner, an opening in the cooktop corresponding in location to the opening in the bottom of the burner, and a light source disposed beneath the cooktop being configured to direct light through the openings in the cooktop and the burner and into the light disc.

5. The appliance of claim 1, wherein only a portion of the light disc is received in the opening in the sidewall of the burner, a shape of the portion of the light disc being semi-circular.

6. The appliance of claim 1, wherein the light disc is removably disposed in the opening in the sidewall of the burner.

7. The appliance of claim 1, wherein a portion of the light disc extends beyond an outer edge of the burner.

8. The appliance of claim 1, further comprising a light source disposed below the cooktop away from the burner, the light source configured to project light into the light disc.

9. The appliance of claim 8, further comprising an opening in the cooktop below the burner, the light source positioned beneath the opening in the cooktop to project light through the opening in the cooktop into the light disc.

10. The appliance of claim 8, wherein the light source is a light emitting diode.

11. The appliance of claim 1, further comprising a coating on a bottom side of the light disc, and an uncoated area on the bottom side to allow light to be projected into the light disc.

12. The appliance of claim 1, wherein light projected into the light disc is emitted from a peripheral side of the light disc.

13. The appliance of claim 1, wherein the light disc is a glass ceramic disc.

14. A lighting system for a gas burner assembly of an appliance, comprising:

a light disc;

a base portion of the gas burner assembly disposed above the light disc;

a cooktop configured to support the light disc and the gas burner assembly, the cooktop including an opening in a surface of the cooktop, the opening exposing an underside of the light disc;

a light source disposed away from an underside of the cooktop configured to direct light into the opening in the surface of the cooktop and the underside of the light disc; and an opening in a sidewall of the gas burner assembly, the light disc being disposed in the opening in the sidewall of the gas burner assembly.

15. The lighting system of claim 14, wherein the light disc is disposed on a top surface of the cooktop.

16. The lighting system of claim 14, wherein the light disc is integrated into a surface of the cooktop.

17. The lighting system of claim 14, wherein a portion of the light disc extends beyond an outer edge of the base portion of the gas burner assembly.

18. A lighting system for a gas burner assembly of an appliance, comprising:

a light disc;

the gas burner assembly having a burner portion, a sidewall of the burner portion including an opening, the opening configured to receive the light disc;

a cooktop configured to support the gas burner assembly, the cooktop including an opening in a surface of the cooktop;

an underside of the burner portion including an opening corresponding in location to the opening in the surface of the cooktop, the opening in the underside of the burner portion exposing an underside of the light disc; and a light source disposed away from an underside of the cooktop, the light source configured to direct light into the opening in the sidewall of the burner portion and the underside of the light disc.

19. The lighting system of claim 18, wherein the light disc is removably disposed in the opening in the sidewall of the burner portion configured to receive the light disc.

* * * * *